US005290978A

United States Patent [19]

Georgacakis et al.

[11] Patent Number: 5,290,978

[45] Date of Patent: Mar. 1, 1994

[54] PROGRAMMER/TIMER WITH RAPID ADVANCE

[75] Inventors: George Georgacakis, Skokie; Richard Bogda, Elmhurst, both of Ill.

[73] Assignee: Eaton Corporation, Cleveland, Ohio

[21] Appl. No.: 951,644

[22] Filed: Sep. 25, 1992

[51] Int. Cl.[5] ..... H01H 43/10

[52] U.S. Cl. ..... 200/38 R; 200/38 A; 200/38 C

[58] Field of Search ..... 200/38 R, 38 A, 38 B, 200/38 C, 35 R

[56] References Cited

U.S. PATENT DOCUMENTS

| | | | |
|---|---|---|---|
| 3,581,028 | 5/1971 | Valbona | 200/38 R |
| 3,760,129 | 9/1973 | Jullien-Davin | 200/38 R |
| 3,819,886 | 6/1974 | Homan et al. | 200/38 B |
| 4,146,760 | 3/1979 | Voland | 200/38 A |
| 4,412,110 | 10/1983 | Wojtanek | 200/38 A X |
| 4,497,986 | 2/1985 | Zink et al. | 200/38 R |
| 4,892,983 | 1/1990 | Bogda et al. | 200/38 R |
| 4,948,928 | 8/1990 | Willigman | 200/38 A X |
| 4,983,790 | 1/1991 | Bogda et al. | 200/38 B |

*Primary Examiner*—J. R. Scott
*Attorney, Agent, or Firm*—R. A. Johnston

[57] ABSTRACT

An electromechanical appliance programmer has a cam drum indexed by primary advance motor drive for sequentially operating plural appliance function switches. The cam shaft is axially slidable by user actuation and moves an annular cam ring for moving a slider for actuating and de-actuating a line power switch. An internally-toothed gear is attached internally to the cam drum web and is engaged by a drive pinion of a second motor drive for effecting rapid advance of the cam drum.

10 Claims, 2 Drawing Sheets

PROGRAMMER/TIMER WITH RAPID ADVANCE

BACKGROUND OF THE INVENTION

The present invention relates to programmer/timers for appliances and particularly to electromechanical programmer/timers employed in clothes washers, dishwashers, and clothes dryers. Electromechanical programmer/timers for these types of appliances typically utilize a rotary cam drum for sequentially actuating a plurality of switches which control the various machine functions during the program cycle. Electromechanical programmer/timers of this type have found widespread acceptance in household appliances because of their low manufacturing costs and accurate repeatability and reliability. Programmer/timers of this type commonly employ a subfractional horsepower timing motor which operates a cam advance mechanism either of the direct gear reduction variety or of the ratchet and pawl type indexing mechanism.

In recent times, it has become desirable to provide improved rapid user selection of portion of the program cycle in appliances while retaining the advantages of an electromechanical programmer/timer.

The more commonly used electromechanical appliance programmer/timers have a user-rotatable knob attached to the main cam shaft which enables the user to rotate the cam to a desired position for a selected portion or a full revolution of the cam drum for the program cycle.

Typically, manually actuated programmer/timers have the shaft to which the knob is attached axially movable to provide actuation and deactuation of the line power switch controlling current flow to the cam advance motor and to all of the appliance load function switches. This arrangement has proven to be user friendly and low in manufacturing cost, and has found widespread acceptance in household appliances.

It has thus been desired to retain the appearance, feel, and method of actuation for household appliance programmer/timers and yet provide a rapid advance function in the programmer/timer to enable the user to select automatically a portion of the program without the need to manually rotate the entire cam drum for positioning the cam to provide the desired machine functions.

SUMMARY OF THE INVENTION

The present invention provides an electromechanical programmer/timer having a rotatable cam drum advanced by a first motor driven advance mechanism for sequentially actuating a plurality of appliance load function switches. The cam drum shaft has a knob user rotatable for selecting the initial position of the cam drum to the desired portion of the rotation thereof to enable user selection of the desired portion of the program. A second rapid advance motor engages an internally toothed gear attached to the interior of the cam drum and which provides rapid rotation of the cam drum upon energization. The rapid advance motor may be energized by a user actuated button switch or by a switch provided on the cam drum which is in series with a user actuated arming switch.

The user control knob on the cam shaft is axially movable for moving an annular cam which actuates and de-actuates a separate line power switch controlling current flow to the advance motors and the appliance load function switches.

DETAILED DESCRIPTION

Figure 1:
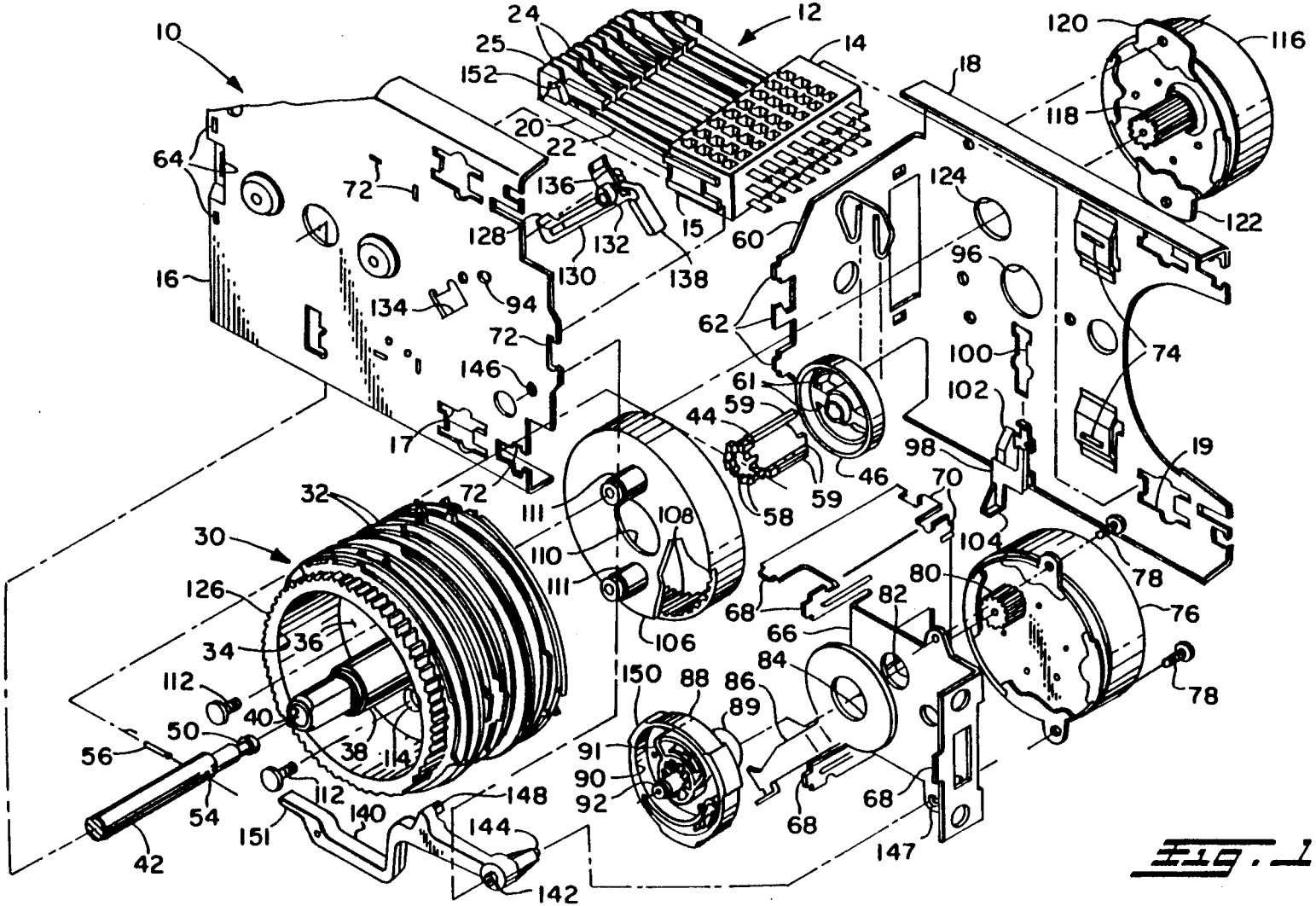
FIG. 1 is an exploded view of the programmer/timer of the present invention.
Figure 2:
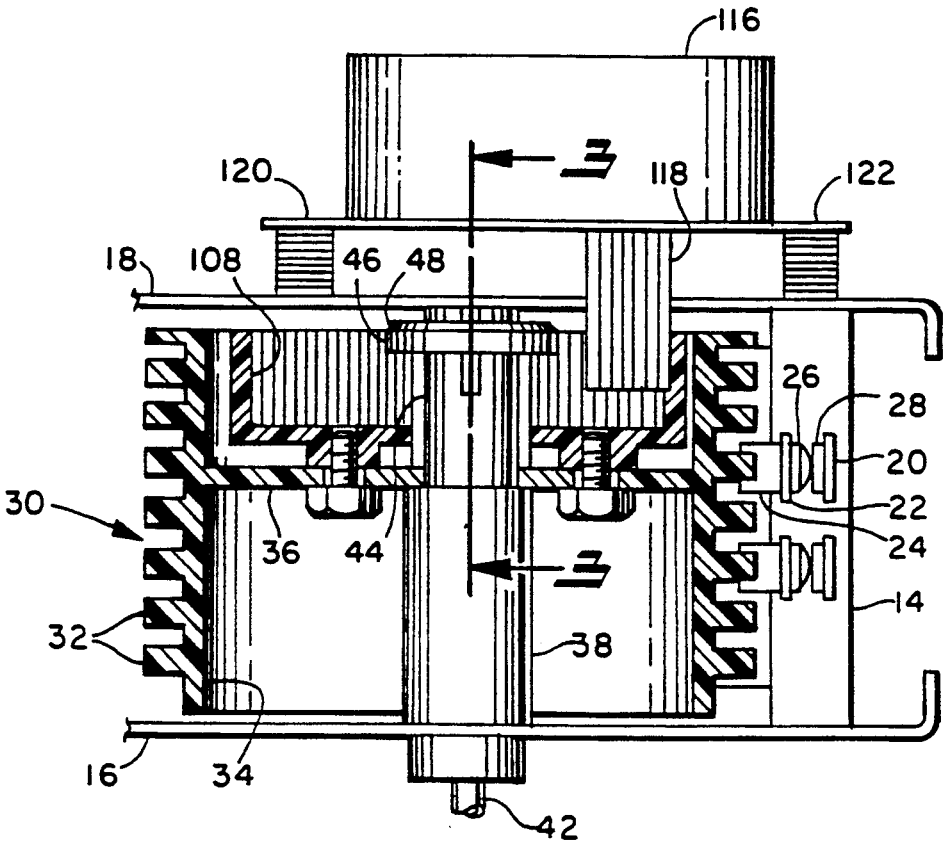
FIG. 2 is a transverse section view taken through the axis of the cam drum of the programmer/timer of FIG. 1; and, FIG. 3 is a section view taken along section indicating lines 3—3 of FIG. 2.
Figure 3:
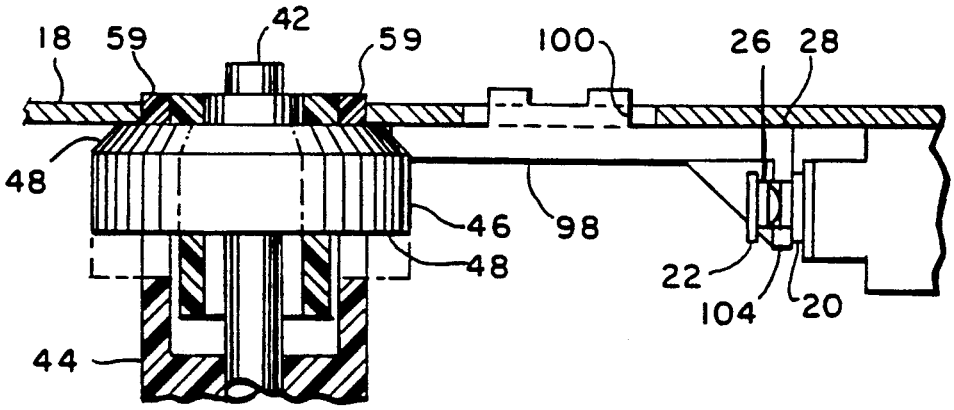

Referring to FIGS. 1–3, the programmer/timer indicated generally at 10 has a switch block subassembly indicated generally at 12 which has an insulating block 14 disposed between a front plate 16 and a rear plate 18 which form the basic deck structure or housing of the programmer/timer. The switch subassembly has a plurality of contact blade sets with opposite blades of one set indicated by reference numerals 20, 22, and which extend in generally parallel spaced cantilever arrangement from the block 14 with one of the blades having a cam follower 25 thereon. A pair of electrical contacts not shown in FIG. 1, but visible in FIGS. 2 and 3 is provided, one on each of the blades and denoted respectively by reference numerals 26,28 in FIGS. 2 and 3.

A program cam drum indicated generally at 30 has a plurality of peripheral cam tracks denoted typically by reference numeral 32 provided about the periphery thereof. Cam drum 30 has an inner diameter 34 supported on a web 36 which extends radially outwardly from a hub 38 which has a bore 40 therethrough which has a shaft 42 received therethrough and upon which the bore 40 is journalled for free rotation with respect thereto.

It will be understood that the switch insulator block 14 has lugs denoted by reference numeral 15 on one end thereof with a corresponding set of lugs provided on the opposite end of block 14 (not shown in FIG. 1). The lugs 15 engage slot 17 provided in the front plate 16; and, the unshown lugs on the opposite end of block 14 engage a similar slot 19 provided in the rear plate 18 for locating and securing the switch subassembly 12 in position on the housing.

Each of the switches has surfaces or lobes 24 provided on the other blade thereof to engage the spaces between cam tracks 24 which lobes 24 ride on the base circle of the cam drum or the space between an adjacent pair of tracks 32 in a manner well known in the art. Cam followers 25 are lifted by the surfaces on the cam tracks 32.

Shaft 42 also passes through a collar 44 and through an annular line switch cam member 46.

Referring to FIGS. 1 through 3, the annular line switch cam member 46 has an annular cam surface 48 provided thereon and is retained on the shaft 42 by any suitable expedient such as a snap locking in groove 50.

Shaft 42 has a transverse aperture 54 provided therein through which is received a cross pin 56 which has its length so as to extend transversely beyond the outer surface of the shaft on opposite sides thereof. The opposite ends of the pin 56 engages spaces formed between a plurality of axially extending lugs or teeth 58 provided on the end of a collar 44.

The rear plate 18 has a portion bent at right angles thereto denoted by reference numeral 60 which has a plurality of tabs 62 provided thereon which engage corresponding slots 64 provided in the front plate 16 for securing the one end of the rear plate 18 in spaced relationship with front plate 16.

The opposite end of plates 16,18 is secured in spaced relationship by subframe member 66 which has a generally Z-shaped configuration with tabs 68,70 provided on opposite ends thereof for engagement respectively with corresponding slots denoted respectively by reference numerals 72,74 in the front and rear plates. Subframe 66 serves as a platform for the mounting of the primary or main drive motor 76, which is attached to the subframe 66 by suitable fasteners such as screw 78; and, motor 76 has a speed reducing gear train (not shown) included in the housing, the output of which is in the form of a drive pin, pinion, or splined shaft 80 extending from the motor housing. Pinion 80 extends through an aperture 82 provided in subframe 66 and through an aperture 84 provided in an anti-reverse pawl 86. Anti-reverse pawl 86 is typically journalled on a hub 89 provided on the rear face of cam 88. Pinion 80 engages an internal spline (not shown) formed in the inner periphery of the hub 89. Cam member 88 has a cam track formed therein by eccentric surface 90 and lobe 91. Cam member 88 has a front hub 92 which is journalled in an aperture 94 provided in front plate 16.

Collar 44 has a plurality of axially-extending lugs 59 extending from the end thereof opposite lugs 58; and, the lugs 59 extend through apertures 61 provided in the annular member 46 and also are journalled in an aperture 96 provided in the rear plate 16 for rotation therein. Axial movement of the annular member 46 is also permitted with respect to the collar 44.

A slider member 98 is slidably received in slot 100 formed in the backplate 18; and, the slider has an inclined cam surface 102 provided thereon which surface is contacted by the annular cam surface 48 on member 46 upon axial movement thereof to cause the slider 98 to move downwardly in the slot 100. Slider 98 has a foot portion 104 formed thereon and extending generally at right angles therefrom which foot 104 contacts the tip of one of the blades 22 comprising the line power switch connected electrically for switching current to the motor 76 and the remaining switches in block 14. The slider 98 thus is a line power switch actuator. It will be understood with reference to FIG. 3 that the annular cam member 46 is shown in the actuated position in solid outline and in the unactuated position in dashed outline.

Referring to FIGS. 1 and 2, a generally cup shaped gear wheel 106 is received interiorly of the inner diameter 34 of the drum on the backside of web 36; and, gear 106 has radially inwardly extending teeth denoted by reference numeral 108 in FIGS. 1 and 2 formed about the inner periphery of the wall thereof. Gear 106 has a clearance aperture 110 formed in the center thereof for collar 44 and has a pair of mounting posts 111 disposed diametrically opposed and extending from the face thereof, which posts are attached to cam drum web 36 by screws 112 passing through apertures 114 provided in the web of the cam drum.

A rapid advance motor drive 116 includes a second motor, also series connected to the line switch actuated by slider 98 and includes an internal speed reducing gear train (not shown), the output of which is through an external drive pinion 118. Motor drive 116 is fastened to the rear surface of rear plate 18 by suitable fasteners via mounting tabs 120,122. The motor drive 116 is positioned such that pinion 118 extends through clearance aperture 124 formed in the rear plate 18. Pinion 118 engages the teeth 108 provided in the gear 106. It will be understood that motor drive 116 employs internally a one-way clutching mechanism (not shown) to permit over-running for manual advance or normal drive.

Cam drum 30 has a row of peripheral advance ratchet teeth 126 provided on the front end thereof, which teeth are engaged by a chisel point 128 provided on an advance pawl 130 which has a lug 132 extending from the side thereof which is slidably engaged in slot 134 formed in the front plate 16. A drive lug 136 is provided on the rear face of drive pawl 130 and extends in a direction generally opposite that of the lug 132. Drive lug 136 is engaged by the cam lobe 91 in the eccentric drive 88. Drive pawl 130 also has a stabilizing tab 138 extending from the end thereof in generally right angles to the elongated direction of the pawl.

A sub-internal switching lever 140 has oppositely disposed lugs 142, 144 extending from the end thereof with lug 142 journalled in an aperture 146 provided in the front plate; and, lug 144 is journalled in an aperture 147 provided in the subframe 66. Lever 140 has a lug 148 provided thereon intermediate the ends thereof and extending transversely to the direction of elongation of the lever 140; and, lug 148 is engaged by the outer peripheral cam surfaces 150 provided on the eccentric drive 88 which causes lever 140 to pivot about the end lugs 142, 144 and causes the distal end 151 of the lever to engage a lug 152 provided on the blade 20 on one of the switches to perform a desired sub-internal switching function.

In operation, rotation of the eccentric member 88 by drive pinion 80 upon energization of main drive motor 76 causes pawl 130 to slide or oscillate in slot 134 and the chisel tooth 128 to sequentially engage teeth 126 in a ratcheting action to index the cam drum 30. Upon user closure of an auxiliary switch (not shown) energization of motor 116, drive pinion 118 rotates gear 106 in a rapid advance to rotate the cam drum 30 to a desired position.

The shaft 42 is adapted to having a knob (not shown) attached to the end thereof for user axial movement of the shaft which causes corresponding axial movement of annular cam member 46 and movement of line power switch blade 22. When the shaft 42 is moved to the left in FIG. 1, closing of the line power switch is effected; and, when the shaft is moved to the right, cam member 46 moves slider 98 downwardly to open the switch.

The present invention thus provides a unique and novel rapid advance function to an existing electromechanical appliance programmer/timer in a manner which obviates the need for redesign of the main cam drum and thereby minimizes the manufacturing costs and eliminates retooling of the main cam. The present invention provides rapid advance by the addition to an existing electromechanical programmer/timer by the addition of an internally-toothed gear attached to the internal web of the main cam drum with an auxiliary timing motor drive attached to the rear plate of the programmer/timer to engage the internal teeth on the gear attached to the cam drum.

Although the invention has hereinabove been described with respect to the illustrated embodiments, it will be understood that the invention is capable of modification and variation, and is limited only by the scope of the following claims.

We claim:

1. A programmer/timer for an electrically operated appliance comprising:

(a) housing means;

(b) a plurality of appliance load function switches associated with said housing means;

(c) first cam means rotatable on said housing means operable upon rotary advancement for sequentially actuating and de-actuating said function switches in accordance with a predetermined program, said first cam means including gear means rotatable therewith;

(d) primary advance means associated with said housing means, including a primary motor and ratchet and pawl means, operable for effecting said advancement, said first cam means including override means operable to permit user manual advancement;

(e) rapid advance means associated with said housing means, including a second motor, operable to engage said gear means cause said ratchet to overrun said pawl means and advance said cam means at a rate substantially greater than said primary advance means;

(f) line switch means associated with said housing means and operable to switch power to said motors and said load switches; and, (g) second cam means disposed concentrically with said first cam means, said second cam means user-movable in a direction generally axially with respect to said first cam means, said second cam means operable for actuating and de-actuating said line switch means.

2. The programmer/timer defined in claim 1, wherein said cam means includes a rotary drum having plural cam tracks on the outer periphery thereof; and, said gear means includes an annular rim with teeth disposed on the inner periphery thereof and said rapid advance means has a drive pinion engaging said teeth.

3. The programmer/timer defined in claim 1, wherein said housing means includes a front and rear plate means disposed in spaced generally parallel arrangement with spacer plate means therebetween said first and second cam means disposed therebetween with said rapid advance means mounted on said rear plate means and said primary advance means mounted on said spacer plate means.

4. The programmer/timer defined in claim 1, wherein said second cam means includes an annular tapered surface for operating said line switch means.

5. The programmer/timer defined in claim 1, wherein said second cam means includes an annular tapered surface and a cam follower contacting said annular surface, said follower slidably disposed on said housing means for actuating and de-actuating said line switch means.

6. The programmer/timer defined in claim 1, wherein said gear means comprises a member attached to said first cam means having an annular rim with a plurality of inwardly-extending teeth disposed circumferentially thereabout and supported on a radially inwardly extending web.

7. The programmer/timer defined in claim 1, wherein said housing means includes a front and a rear plate means disposed in generally spaced parallel arrangement with spacer plate means therebetween said primary motor mounted on said spacer plate means and said secondary motor mounted on said rear plate.

8. The programmer/timer defined in claim 1, wherein said cam means includes a hollow cam drum and said rapid advance means includes an internally-toothed gear attached to said drum in said hollow, with a drive pinion on said second motor means engaging said toothed gear.

9. The programmer/timer defined in claim 1, wherein said rapid advance means includes one-way overriding clutch means.

10. The programmer/timer defined in claim 1, wherein said gear means comprises a gear attached to said first cam means.

* * * * *